United States Patent [19]

Pressman et al.

[11] 4,103,895

[45] Aug. 1, 1978

[54] CONCEALED PATTERN DETECTION GAME

[76] Inventors: Gerald L. Pressman, 7925 Rainbow Dr., Cupertino, Calif. 95014; Louis Wilk, 12440 Hilltop Dr., Los Altos Hills, Calif. 94022

[21] Appl. No.: 668,376

[22] Filed: Mar. 19, 1976

[51] Int. Cl.[2] ..... A63F 9/06

[52] U.S. Cl. ..... 273/153 R; 35/9 C; 35/35 A; 273/1 E; 273/DIG. 27; 273/DIG. 28

[58] Field of Search ..... 273/153 R, 1 E, 130 AB, 273/131 A, 136 A, 139, DIG. 27, DIG. 28; 35/9 C, 22 R, 35 A, 36, 37, 38

[56] References Cited

U.S. PATENT DOCUMENTS

| | | | |
|---|---|---|---|
| 1,077,865 | 11/1913 | Atkins | 273/DIG. 27 |
| 2,619,349 | 11/1952 | Abrahamson | 273/131 A |
| 2,808,263 | 10/1957 | Goldfinger | 35/22 R X |
| 3,057,082 | 10/1962 | Wellington et al. | 35/9 C |
| 3,508,344 | 4/1970 | Thomas | 35/9 G |
| 3,771,240 | 11/1973 | Matui | 35/9 C |
| 3,778,058 | 12/1973 | Rausch | 273/1 E |
| 3,826,499 | 7/1974 | Lenkoff | 273/139 X |

FOREIGN PATENT DOCUMENTS

| | | | |
|---|---|---|---|
| 653,661 | 12/1962 | Canada | 273/153 R |
| 473,737 | 8/1952 | Italy | 273/139 |
| 339,449 | 12/1930 | United Kingdom | 273/1 E |

*Primary Examiner*—Anton O. Oechsle

[57] ABSTRACT

A game or test of skill which is comprised of three principal components: a playing surface that either conceals or suggests a secret pattern of paths, a probe for selecting points on the playing surface, and an indicator that reveals whether a selected point belongs on the pattern of paths. In a preferred form of the game the playing surface is a small card on which is marked a grid that indicates the possible positions and orientations of the concealed paths in the pattern. A start point is indicated on the grid; the player places a hand-held pencil-like probe at the start point and tries to find a continuous path from the start point to the end point. The probe leaves no mark on the card, but the player is aided by the indicator which provides a signal when the probe is on-path—the signal ceases abruptly if the probe is moved off-path. The end-point is reached when the probe arrives at a designated end-point line of the grid without an off-path indication, or a separate end-point signal (for example, a bell) can sound when the end-point is reached. The object of the game is to traverse the grid from start to end without once leaving a pattern path, and to do this in the fewest possible attempts.

13 Claims, 17 Drawing Figures

CONCEALED PATTERN DETECTION GAME

BACKGROUND OF THE INVENTION

The maze is a pattern-detection game that has been popular for a long time, particularly with children. The usual printed form of maze provides full visibility of the pattern, and an unobstructed path is traced from start to finish with a pencil. While simple mazes may be memorized by tracing with a non-marking pointer, attempts to make the game more challenging by increasing the pattern complexity present such a formidable problem of pattern learning that is is almost never attempted, and the path is usually traced with a marking pointer.

The prior art includes U.S. Pat. No. 3,539,190 to Ronald W. Redo, patented Nov. 10, 1970; U.S. Pat. No. 3,540,731 to Raymond L. Muncey, patented Nov. 17, 1970; and U.S. Pat. No. 2,939,709 to Louis L. Verveer, patented June 7, 1960. None of these present a maze or pattern-learning challenge characterized by an extensive variety of easily-changed patterns and the use and training of memory through a combination of trial, error, and judgement in the solution process rather than visual perception or pure chance.

SUMMARY OF THE INVENTION

The subject invention is a pattern-detection game that permits generalization of the maze puzzle beyond the task of simply once finding a continuous path through a network of paths, and converts a routine game in which chance is predominant into a genuine test of skill. In the game disclosed herein a pattern of paths (which may or may not be a maze) is concealed from the player; instead, the player is presented with the three principal components of the game, as follows:

(a) A playing surface on which the player can conceive the existence of a secret pattern or maze that cannot be explicitly seen or otherwise directly detected except as described in (b) and (c) below. The surface may actually conceal a pattern, or the concealment may be implied, with the pattern contained in electronic circuits separate from the playing surface. As described in more detail hereinafter, the surface may be marked with a guide grid that specifies all allowable locations of the paths of the pattern.

(b) A selector by which the player may select specific points or areas of the playing surface without necessarily leaving a mark on the playing surface. The selector is preferably a probe, the point of which is placed on the playing surface to make the selection.

(c) An indicator which transmits a signal to the senses of the player as to whether the point or area of the surface, as selected at that moment by the selector, corresponds to a segment of the secret pattern.

The player attempts to discover properties of the secret pattern by using the information provided by the indicator while selecting areas with the selector. Specifically, if the pattern is a maze, the property to be discovered is a continuous path that connects a start point to an end point.

With the foregoing in mind, it is a primary object of this invention to provide a challenging and interesting pattern detection game or test of skill that can retain geometrical simplicity in the solution so as to encourage repeated attempts until the pattern is learned.

It is another object of this invention to permit maze and other pattern-detection games to be embodied in a small, convenient form that does not require playing pieces, tokens, etc.

It is another object of this invention to provide a game with rapid response to player actions so that interest is maintained, and the game can be rapidly completed.

It is a further object of this invention to provide a game that emphasizes player skill while minimizing the effect of chance on the outcome.

It is also an object of this invention to provide a game playable by blind, deaf, or both blind and deaf people.

It is an additional object of this invention to provide a pattern-detection game that can be played either by an individual alone, or competetively by two or more persons, through the provision of meaningful scoring methods such that player's skill dominates the score value.

It is yet another object of this invention to provide a game or test of skill that allows an unlimited variety of puzzles, problems, and games to be practiced with the same apparatus, with the type of game and difficulty level selectable by the player.

Among the features of the present invention is the degree of freedom permitted the player in the selection of areas on the playing surface. The player is not constrained to stay within channels or grooves, between pins, or on tracks. Nor is the player restricted in the selection of playing procedures by the nature of this invention. It is contemplated that any point on the playing surface is open to selection and the player may use unconventional procedures (such as random selection) to detect the solution property of the secret pattern.

Another feature of this invention results from the fact that it restores some of the pattern obscurity associated with the ancient hedge or wall mazes. However, since difficult mechanical constructions are not required in the present invention to obtain such obscurity, the principles may be applied to full-size mazes for walking through without the need to construct barriers.

This invention is further characterized by great freedom in the design of patterns, all of which may be used in the same apparatus. Such flexibility is severely limited in mechanical or structural mazes. This flexibility permits the game of this invention to be played by people with diverse skill levels, including small children. Game rules and scoring methods compatible with the present invention permit testing of both the mental skills of pattern memory and judgement, and the physical skills of manipulation of the selector in response to the information provided by the indicator.

In a preferred embodiment, the secret pattern is concealed in a small card (for example, about four inches by six inches in size) which is inserted into the playing apparatus; the surface of the card is printed with the guide grid. Several cards with different patterns may be used in association with the same apparatus so that an unlimited variety of games may be provided the player. To play the game, a pencil-like probe is placed at the start point marked on the grid, and a signal tone is sounded by the device. As the player moves the probe over the grid, the tone continues to sound as long as the probe follows a guide grid line that belongs to the concealed secret pattern, but ceases abruptly if the player tries to follow a guide grid line that is not on the pattern. If the tone stops, the player must retreat and try another path; this is considered an error. If the game card is specified as one containing a maze pattern, then there will be at least one true path that connects the start point and a finish point, and the player must try to locate a true path. Not all pattern paths will necessarily be a part of a continuous true path; some may lead into "dead ends", requiring the player to backtrack to find the true path. When the end of a true path is reached (this point is preferably not marked on the guide grid), a special signal may sound to indicate success.

Playing the first time through is mainly a trial-and-error process, much like the playing of a printed maze. However, the present invention permits the game to be repeated immediately, while the path just traversed is still fresh in the player's memory. The player's skill and pattern recollection ability makes each subsequent attempt faster and accomplished with fewer errors; eventually the player should be able to complete the maze with no errors, at which point the game is considered completed. The simplest scoring methods are to either count the total number of plays or measure the total time elapsed to complete the game. More complex scoring methods that emphasize the player's skill are presented in the detailed description of the invention.

The degree of difficulty that can be incorporated into the pattern depends to a large extent on the guide grid design. The simplest grid is a pattern of orthogonal lines spaced at regular intervals. Even a simple grid consisting of four horizontal and six vertical lines allows the construction of maze patterns that require an adult several attempts to decipher. More complex guide grids are possible, including those with irregularly-spaced lines, curved lines, diagonal lines, etc. Perhaps the most difficult variation involves a playing surface with no grid at all, so that the player has no guide as to the position and direction of the secret pattern lines.

The techniques used to implement the game would preferably involve electronics, although purely mechanical methods are also conceivable. In the preferred embodiment, electronic circuits are used in conjunction with a card construction that defines the pattern of paths as electrically conductive areas aligned with and spanning the guide grid lines. The conductive path pattern is covered with a paper layer on which the guide grid is printed. A high-frequency electrical signal is conducted to the probe tip. When the probe is directly over a conductive path, the high-frequency signal is coupled to the conductive path and the signal sensed by the electronic circuits connected to the conductor. When a strong signal is sensed, the electronic circuit activates the tone signal. When the probe moves off the path the coupling is poor, the signal fades, and the tone stops. Preferably, a separate conductive area at the end-point picks up the signal from the probe, which can be used to sound or flash a special signal indicating arrival at the end point. Cards with conductive paths printed or silk-screened with conductive paint can be produced inexpensively so that many different cards can be made available for use with the apparatus described above.

Alternative approaches to implementation include a permanent playing surface with conductive paths forming the guide grid segments. The conductive segments would be isolated from each other at the nodes of the grid; therefore the pattern can be invisibly selected through internal programming that selectively transmits electrical signals to segments of the guide grid to form the secret pattern. In another embodiment of the principles of this invention, the guide grid may be displayed on the face of a cathoderay tube or television picture tube. The selector may be a "light-pen" probe or an internally-generated cursor controlled by the game player.

No limitation on overall size of the playing surface is intended by presentation of the above as a preferred embodiment. For example, it is contemplated that the playing surface could be made large enough for the player to walk on. The presence of the player over a path can be sensed through the use of a selector carried by the player, or the player's weight could activate the indicator signal. In this form the player tries to walk the maze from start to finish, preferably repeating the attempts until no errors are made. This form of the game is preferable for use in amusement parks and carnivals. The principles presented herein permit such embodiments of large size that can be portable and allow rapid, simple changing of patterns.

The game comprising the three principal components described above can be used to form other than maze games; any puzzle involving the detection or deciphering of a secret pattern may be made. For example, the concealed pattern may be a diagram, message, text, picture, etc., which is to be detected by probing the playing surface with the selector. In addition, it is anticipated that the applications of this invention will extend beyond the field of amusements and find value in psychological testing and behavioral research.

These and other objects, features, and advantages of the present invention will be more apparent after referring to the following specification and accompanying drawings.

DESCRIPTION OF THE SPECIFIC EMBODIMENTS

Figure 1:
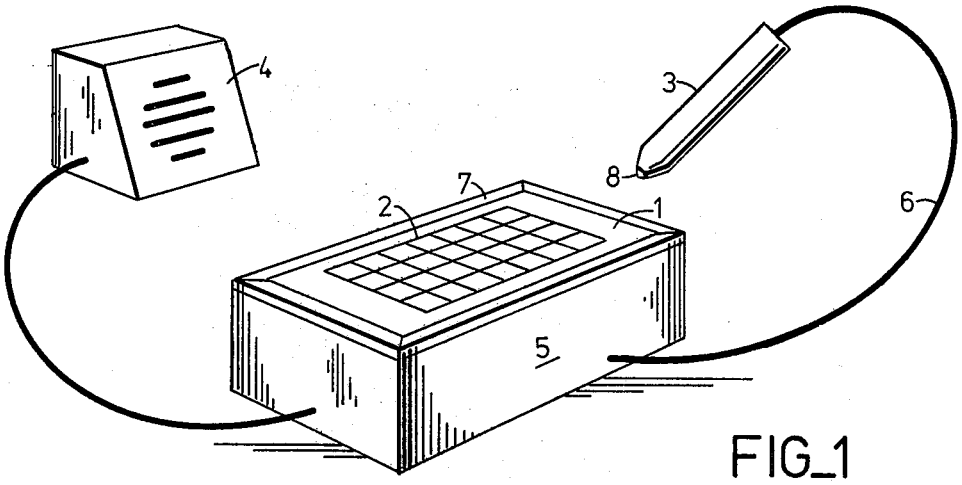
FIG. 1 is a view of a preferred embodiment of the invention.

An embodiment of the invention that is preferred because it combines simplicity of design, low construction cost, flexibility in game selection, and small, convenient size is presented in FIG. 1. The principal components of the game are the playing surface 1, which is shown marked with a guide grid 2; the selector which is depicted as a probe 3; and the indicator shown as an audible device 4. In this embodiment the playing surface 1 and guide grid 2 are incorporated into a game card which is placed on or within apparatus enclosure 5 and held in place by frame 7; circuit connections to the game card are made within the frame area. Sensitive elements within the game card respond to the close approach of tip 8 of selector probe 3 which is connected to electronic circuits contained in enclosure 5 by means of cable 6. To play, the selector probe 3 is guided along the lines of guide grid 2 in order to discover characteristics or properties of a secret pattern concealed by the playing surface 1. Information is provided by indicator 4, which produces an appropriate sensory signal to indicate when the probe is over one of the pattern paths. The sensory signal may be audible, visual, or tactile, since the purpose is to communicate information to the player as to the location of the probe with respect to the concealed pattern. A satisfactory indicator has been found to be a tone that continues as long as the probe is over a portion of the secret pattern, but ceases when the probe is moved off the pattern. Conversely, a tone or buzzer may sound only when the probe is moved off the secret pattern; alternatively, a change in tone characteristic could also provide the essential information. To facilitate the use of the game by deaf people, a signal light or tactile sensation can be used instead of or in addition to the above mentioned tone. Although indicator 4 is shown as a separate component in FIG. 1 for purposes of clarity in describing the embodiment, it is most likely to be contained within enclosure 5 for convenience.

Figure 2:
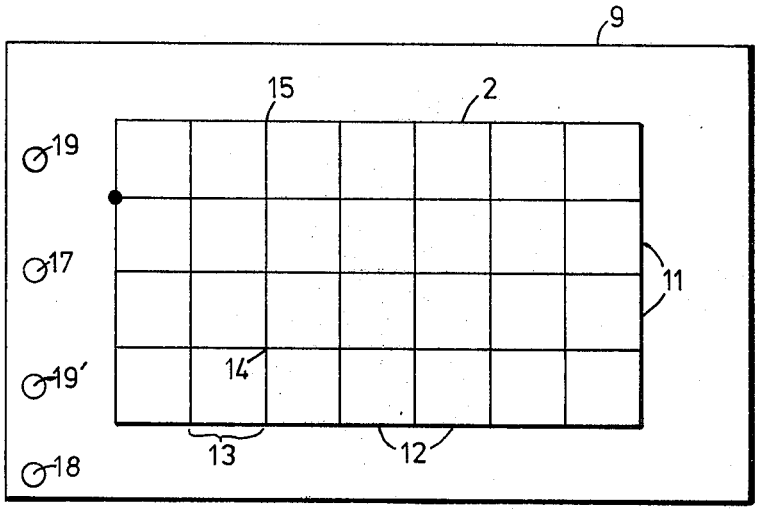
FIG. 2 is a view of the game card and playing surface employed in the embodiment of FIG. 1.

FIG. 2 is a more detailed view of the game card referred to in FIG. 1. Particular features of the game card 9 are the grid 2, and connection apertures 17, 18, and 19. The elements within the card that are sensitive to the proximity of the selector probe and define the secret pattern of paths are concealed by the card surface, thus openings 17, 18, and 19 are provided so that the sensitive areas may be exposed for contact and connection with electronic circuits. Guide grid 2 is formed from a series of spaced verticals one of which is the heavy line indicated by numeral 11, and a series of spaced horizontals one of which is the heavy line indicated by numeral 12. The grid nodes are where the verticals and horizontals intersect, including specifically internal nodes 14 and edge nodes 15. Segments of the guide grid are the portions of the grid lines that lie between the nodes as indicated by numeral 13. A starting point 10 may also be marked on the guide grid.

Although printed grid markings on the playing surface are contemplated for general use, substitution or addition of grooves or raised areas coincident with the grid lines and also indicating the start point may be provided on cards or games designed to be used by blind people.

Figure 3:
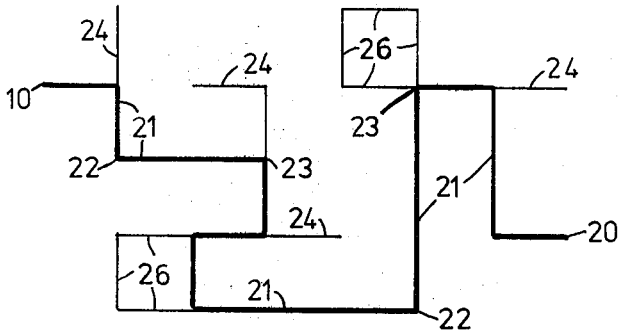
FIG. 3 is an example of a secret pattern that is a maze.

FIG. 3 is an example of a pattern of paths that may be used in conjunction with game card 9 to provide a maze game. The heavy line 21 represents the true path, the continuous path extending from the start point 10 to the end point 20. It can be seen in FIG. 3 that all pattern paths are not part of the true path; some paths indicated by numerals 24 lead to dead-ends; other paths may return to form loops as indicated by numerals 26. The end point 20 is preferably not marked on the guide grid; instead, identification of the end point for the player may be accomplished in several more interesting ways. Examples are:

(1) A special signal may be provided when the selector probe is placed over the end point; this signal is preferably distinct from the on-path indicator—if the on-path indicator is a tone, the end-point signal could be a bell.

(2) Rules of pattern construction may be specified and known to the player so that only specific areas of the grid may contain valid end points. For example, on a rectangular guide grid, the last (furthest from the left, for example) vertical could be designated the end-point line, and if no special end-point signal is provided, the point of intersection where the true path reaches the end-point line will be known to be the end point. A path that approaches, but does not reach the end-point line is a dead end.

Figure 4A:
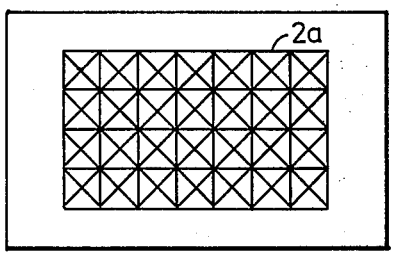
FIGS. 4A through 4D are examples of alternative guide grid configurations.
Figure 4B:
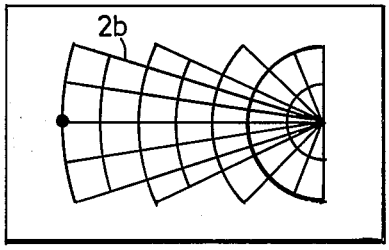
Figure 4C:
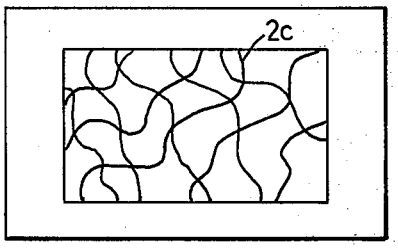

When a guide grid is displayed on the playing surface, the pattern of paths is drawn to coincide with the gride lines; thus every pattern path coincides with a guide grid line, but not every grid line represents a pattern path. Therefore, complex or fine guide grids permit complex and interesting patterns that are more challenging to solve. A pattern junction is where a path changes direction as indicated in FIG. 3 by numeral 22, or where several paths meet as indicated by numeral 23. It should be apparent that pattern junctions can occur only in coincidence with guide grid nodes. The concealed pattern detection game is made more difficult by increasing the number of possible junctions; since each guide grid node represents a potential junction, providing more nodes increases the difficulty. The complexity also increases as the number of possible choices at each node increases; the simple rectangular grid presents a choice of three directions at each internal node. With these considerations in mind, a variety of guide grids may be designed to accomplish different results. Examples of a variety of possible guide grids 2*a*, 2*b*, and 2*c* are shown respectively in FIGS. 4A through 4C. In FIG. 4A, complexity is increased by adding choices to each node. In this design, seven choices are presented at each internal node, while four choices are presented at the edge nodes. Guide grids may also be designed to simplify the game as in FIG. 4B, wherein the end point is clearly apparent, and choices are restricted by the shape of the grid. Although guide grids are generally contemplated as being uniform and regular constructs, interesting results may be obtained with irregular and non-uniform designs as depicted in FIG. 4C. Perhaps the greatest difficulty is achieved with the gridless playing surface, FIG. 4D, since the player has no guide to the position or direction of the pattern paths. The gridless surface permits the maximum freedom in the design of secret patterns: diagrams, drawings, or messages may be employed as the concealed pattern.

Pattern rules, known to the player, can be used to simplify the game for young people; examples of such rules are: (a) no true-path segment leads away from the end point, and (b) no dead-end segments are permitted in the pattern. Other pattern rules may be implemented in order to increase the influence of the player's skill over that of chance; examples of such rules are: (c) no loops are permitted in the pattern, and (d) an end-point line is designated. With these latter rules in mind, the player would be able to use some judgement in selecting his course even on the first attempt. A demonstration of the impact on the game of such rules is provided by calculation of the probability of an errorless game on the first try. For the pattern of paths shown in FIG. 3, if no pattern rules are given, the chance of a first-try completion is one in 51,018,336; when rules (c) and (d) above apply, and the player makes no errors in judgement, the probability of completion on the first attempt increases to one in 1,889,568. These probability figures also serve to demonstrate a novel characteristic of the present invention. The maze path of FIG. 3 is quite simple, and if it were visible to the player as a printed maze, even a moderately skilled player would be almost certain to complete the maze without error on the first attempt. When the pattern is concealed as contemplated in the present invention, however, the chance of accomplishing the same feat drops to insignificant levels, yet the essential simplicity of the pattern still exists and permits memorization in a reasonable time.

Figure 5A:
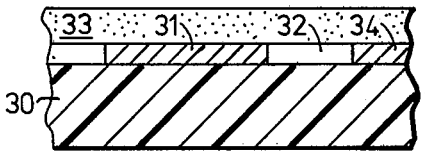
FIGS. 5A and 5B are sectional views of two types of game card constructions.

In the preferred embodiment of the present invention the playing surface is part of a game card constructed of paper or plastic or similar material. The card should be small enough so that it may be easily carried and handled; a suggested dimension for such a card is four by six inches. The card is made up of several layers as depicted in FIG. 5A; the base layer 30 is made of cardboard or plastic; the middle layer 31 is the secret path pattern made of electrically conductive material; the upper layer 33 conceals the pattern 31. The upper covering layer may be a plastic film, paper, or a coated, painted, or printed insulative covering that conceals the pattern 31. The guide grid is marked on the cover layer 33 in alignment with concealed pattern 31. In order to improve electrical performance it is preferred that the spaces between path segments be filled with a conductive material 34 which is isolated from the conductive material of paths 31 by gaps 32. This background conductor 34 is maintained at ground potential during operation of the game, and acts to shield the path pattern from pickup of unwanted electrical signals.

Figure 5B:
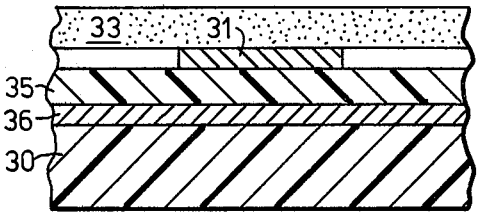

In order that all of the background conductor be in contact with ground potential without unduly increasing the number of external contact points required, it is important that major portions of the background be contiguous, and that these portions at some point reach the edge of the card; there should be no unconnected "islands" of background conductor. This condition will naturally occur in the maze pattern if no loops are included. For patterns that involve loops, and for more general non-maze patterns, the alternative construction of FIG. 5B may be used. In this case base layer 30 is uniformly covered with a conductive layer 36 that serves as a background, which is covered by an insulative layer 35. A conductive pattern consisting of pattern paths 31 only is formed on the insulative layer 35, and as before the upper layer 33 conceals the pattern.

Figure 6:
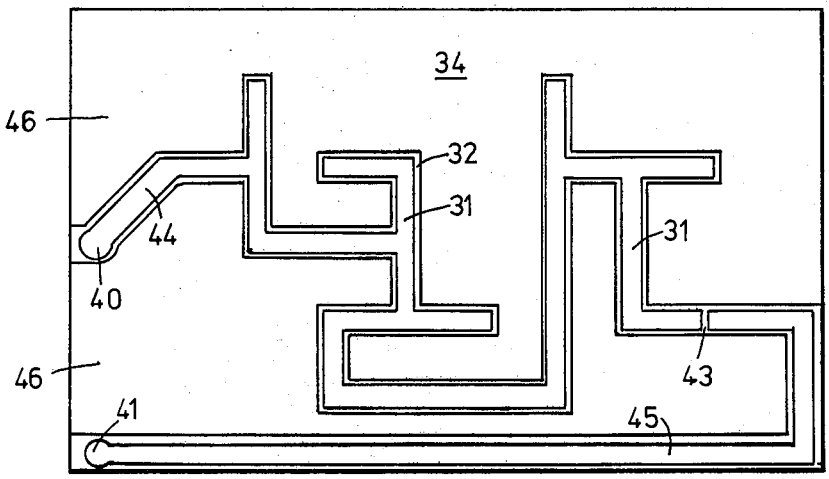
FIG. 6 is a plan view of the conductive pattern in the game card.

Path pattern 31 and background 34 may be printed or silk-screened onto the underside of surface layer 33, over the base layer 30, or over insulator layer 35 using a conductive ink or paint. A plan view of the conductive pattern is shown in FIG. 6. This pattern embodies the maze pattern of FIG. 3 with all loops eliminated. The path 31 of the conductive pattern should be in alignment with the overlying guide grid so that the grid lines lie over the center lines of paths 31. The width of the conductive path 31 is selected to allow reasonable tolerance in the location of the selector probe. Total tolerance of position around a grid line will depend also on the size of the probe tip; the combined effect of path width and probe tip size should produce a tolerance of approximately ±20% to ±30% of the grid spacing so that the player is not severely restricted in the movement of the probe. The conductive background, if coplanar with the path pattern, is isolated from the paths by gaps 32; these should be as small as practical although the actual width of the gap is not critical. It has been determined that a gap width as large as 10% of the grid spacing is satisfactory.

The conductive pattern and background may be printed with inks or paints generally commercially available, and it is preferred that path surface resistivity be less than 200 ohms per square. Suspensions of silver, carbon, or copper are available that provide resistivities in this range, such as Electrodag +504SS (silver suspension), Electrodag +502SS (carbon suspension), and Electrodag 435 (copper suspension) all manufactured by Acheson Colloids Company of Port Huron, Mich. Similar materials are available from other manufacturers. Alternatively, the conductive pattern may be constructed by using the techniques of "printed circuits" in which a metal layer is etched. In the case of the pattern of FIG. 6, the gap area would be etched away, leaving the paths and background isolated from each other. Thickness of the conductive portions is not significant except in the case of some conductive inks where sufficient thickness must be provided to maintain a low surface resistivity.

Areas at the edges of the game card may expose the conductors for contact with external circuitry (as shown in FIG. 6, a path may be extended by means of a non-pattern section 44 to the exposed position 40). Since this embodiment provides for a special end-point signal, an additional conductive path 45 is printed that terminates at end point 43. Path 45 is located outside the grid area to avoid false signals, and extends to exposed area 41. Two areas 46 are provided for making ground contact to the background; this is done in the event that the background conductor is not fully contiguous. As is evident in FIG. 6, the continuous path can divide the background into two unconnected areas.

Figure 7:
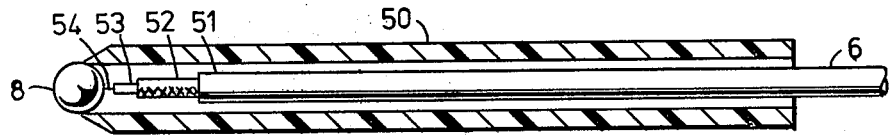
FIG. 7 is a sectional view of a typical selector probe.

It is intended that the conductive paths 31 pick up a signal capacitively coupled or radiated through the insulative upper layer 33 from the probe tip 8. The selector probe construction is shown in FIG. 7 and consists of an insulative housing 50, a conductive point 8, and a shielded connecting cable 6 that contains signal wire 54, insulator 53, shielding 52, and outer covering 51. The probe tip 8 is connected by means of wire 54 to an oscillator contained in the electronic circuits. Although FIG. 7 depicts an insulative housing, a metal casing may also be used if it is insulated from the probe tip.

The size of the probe tip 8 affects the tolerance on probe placement; it has been found that if the width of the conductive path is about 20% of guide grid line spacing, and the probe tip is spherical with a diameter of 1.5 times the path width, the resulting tolerance is approximately ±30% of grid spacing. Excessive radiation of signal from the probe is undesireable, therefore shield 52 should cover the signal wire 54 and its insulator 53 to a point as close as practical to probe tip 8.

Figure 8:
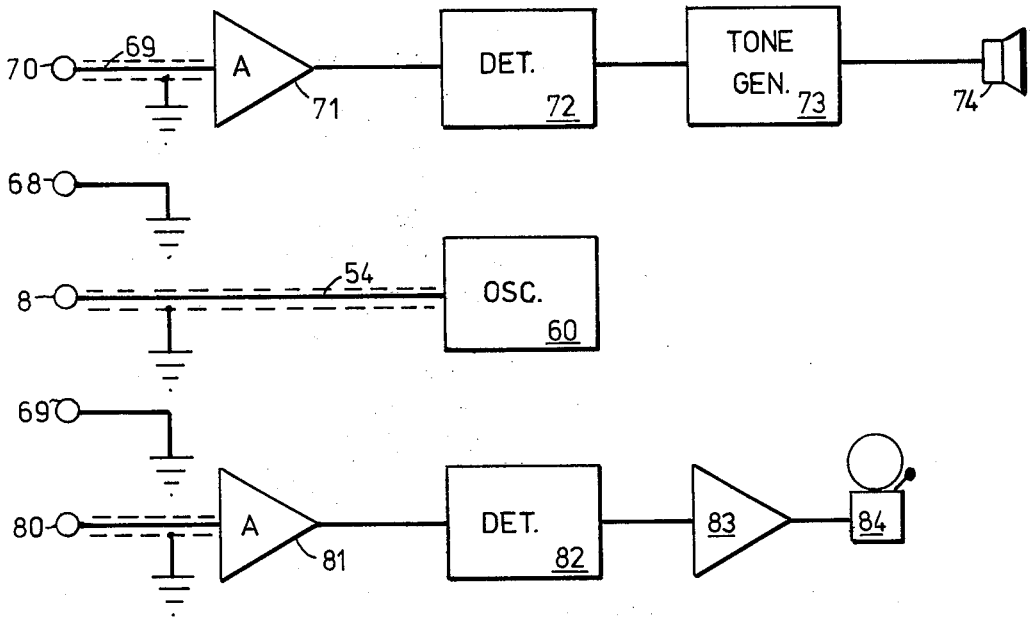
FIG. 8 is a functional-block diagram of a game electronic circuit.

FIG. 8 shows the functional blocks that comprise a workable and practical electronic circuit for use in conjunction with the above described selector probe and game card playing surface to provide the third principal component of the invention, the indicator. Connection is made by connection point 70 which makes contact with conductive area 40 of FIG. 6. The signal is carried by preferably shielded wire 69 to amplifier 71. Amplifier 71 amplifies the signal picked up by the path, and the amplified signal is detected by detector 72 which reacts to the presence of a signal level above a specific minimum to energize tone generator 73 which drives loudspeaker 74 to provide the audible indication. Thus, when the probe is located over a conductive path, the coupling between the probe tip and conductive path is strong and sufficient signal is received to activate detector 72 and generate the audible tone signal.

When the probe is moved off the path, the added distance between the probe and conductive path reduces the signal strength until the detector "turns off" and the tone ceases. A rapid and marked reduction of signal is produced by the presence of the conductive background maintained at ground potential. Grounding connections for the background are indicated at points 68 and 69.

If an end-point signal is to be included in the game, an additional connection 80 is provided that makes contact with conductive area 41 of FIG. 6. This signal, amplified by amplifier 81 and detected by detector 82 occurs only when the probe is over the end point. The output of detector 82, boosted by driver 83, rings the bell 84 to signal arrival at the end point.

The remainder of the circuit of FIG. 8 is the oscillator-signal generator for the probe. Oscillator 60 generates the electrical signal sent through wire 54 to probe tip 8. The frequency of the oscillator may be selected over a wide range: if the frequency is too low, coupling between probe tip and conductive path will generate a weak signal; if the frequency is too high, the capacitance of the shielded cable will load the oscillator and capacitance of the card paths will decrease the signal at the amplifier inputs. It has been determined that frequencies between 50 kilohertz and 100 kilohertz are satisfactory for embodiments of the size disclosed in the above description. For larger-scale embodiments lower frequencies are also practical. In practice, the probe signal is square-wave like rather than sinusoidal since this type of signal is more easily generated with simple, efficient circuitry. The signal sent to the probe should have the maximum practical amplitude that can be generated by the circuitry in order that a strong, noise-free signal can be picked up by the conductive paths.

The electronic techniques for each of the functional blocks of FIG. 8 are well known in modern solid-state electronics and are preferably incorporated in integrated circuits. Amplifiers 71 and 81 may be integrated circuit operational amplifiers connected as ac amplifiers, wide-band audio preamplifier integrated circuits, or ac amplifiers constructed of discrete components. A gain of 10 has been found satisfactory for amplifiers 71 and 81. The detectors may be phase-lock-loop signal detectors available as single-component integrated circuits. Another suitable detector would be one that employs a combination peak-detector/Schmidt-trigger circuit.

The tone generator is preferably an astable multivibrator biased into operation by the detector output. The most pleasing frequencies for the tone lie between 200 and 1,000 hertz; however, the astable multivibrator produces a square-wave-like output that may sound harsh through the loudspeaker. The sound can be improved by filtering out some of the high-frequency components of the tone signal. Bell driver 83 may be a single transistor or a Darlington-connected pair of transistors capable of supplying the current necessary to drive the bell solenoid.

The embodiment described above is a practical and workable form of the invention, but many variations will be apparent to those skilled in the art. Other methods of providing sensitivity of the paths to probe position may be used—for example, the paths may be formed from a pressure-sensitive material that responds to the pressure of the probe tip against the playing surface. Alternatively, the probe tip can contain a light source, the playing surface made translucent, and the pattern of paths composed of electrically photosensitive material such as selenium or cadmium sulfide.

Figure 9:
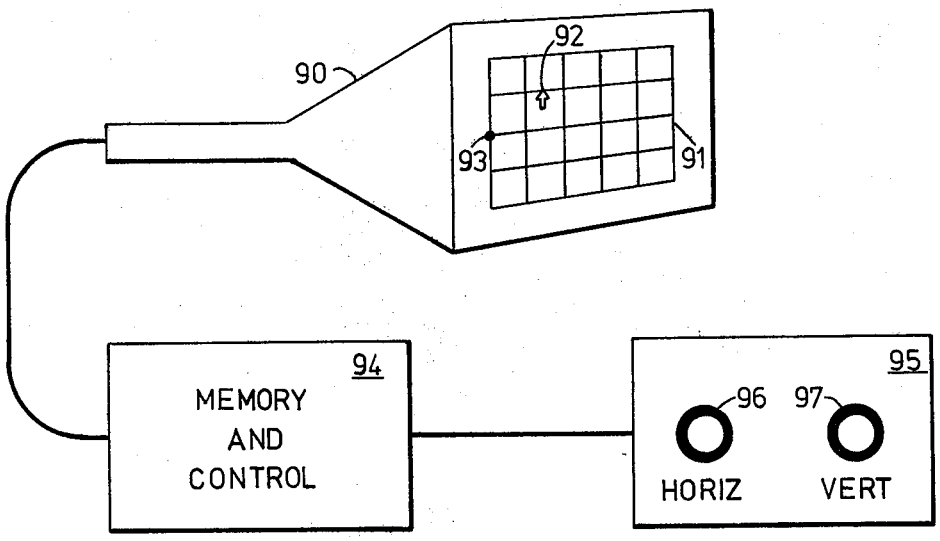
FIG. 9 is an embodiment of the invention as a television game.

Another embodiment is presented in FIG. 9 in which the playing surface is the face of a cathode-ray tube or television picture tube display 90 which implies a secret pattern and displays the guide grid. The display on the tube face is determined by and controlled by memory and control circuits 94. The term "implied" is used in reference to this embodiment because the secret pattern is not physically concealed by the playing surface (the tube face) but is actually contained within the electronic circuits 94. However, the electronic circuits store the pattern in correspondence with points on the display surface so that one may imply or imagine that the surface contains the pattern. The detection of the pattern is accomplished by selecting points on the display surface as if the pattern existed within but concealed by the surface. Two methods, both well known in the art of cathode-ray-tube terminals for computers, can be applied in this embodiment to achieve the selector function. In FIG. 9 the selector is a cursor, which is presented as an example of a selector that is not a probe or pointed device. A cursor is a mark that appears on the display surface and that can be moved to various points of the surface under operator control. In reference to FIG. 9, display tube 90 forms an image of guide grid 91 on its surface; start point 93 may also be indicated. In addition, cursor mark 92, which may be in the form of an arrow, circle spot, or other suitable shape, is displayed on the display surface. Memory and control circuits 94 drive the cathode-ray tube 90 and generate the display of grid 91, start point 93, and cursor 92. The position of the cursor is controlled by the game operator by means of control box 95. Two controls are provided; control 96 moves the cursor in a horizontal direction and control 97 moves the cursor in a vertical direction. The indicator for on-path and off-path positions of the cursor can be an audible tone activated by the memory and control circuits which compare the cursor position to the stored pattern. In this embodiment however, the indicator is preferably visual: the cursor 92 can be displayed in steady or bright illumination when on-path, but in blinking or dim illumination when off-path.

An alternative to the cursor described above is for the selector to be a light-pen. A light-pen is a probe containing a photosensitive tip which is place against the display surface to make a selection. The position of the light-pen is determined by the electronic circuits by the time at which the light from the scanning beam of the cathode-ray tube is received by the pen tip.

Figure 10A:
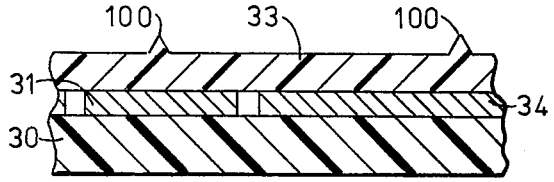
FIGS. 10A and 10B are sectional views of game cards incorporating tactile guide grids.
Figure 10B:
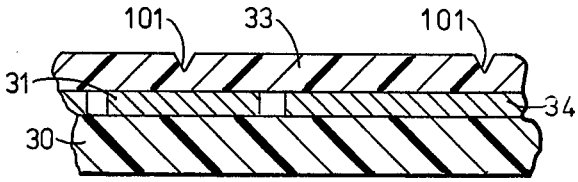

FIGS. 10A and 10B are views of game card constructions in which the visible guide grid in supplemented or replaced by a tactile grid. Game card surface layer 33 is provided with either ridges 100 in FIG. 10A or grooves 101 in FIG. 10B that function as the guide grid and can be sensed by touching. This construction enables the concealed pattern detection game to be played by blind persons.

Figure 11:
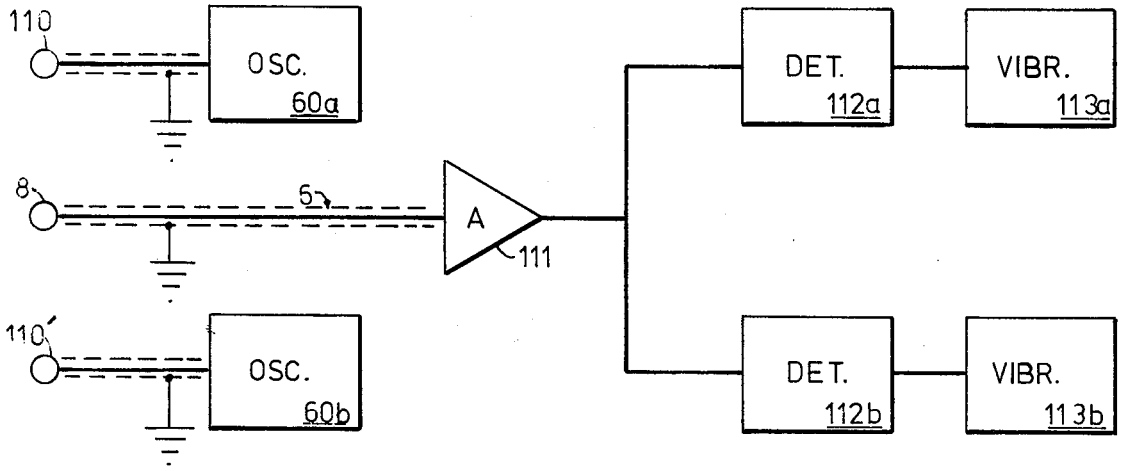
FIG. 11 is a functional-block diagram of a concealed pattern detection game in which signals are applied to conductive paths and are sensed by the probe, and in which the indicator is a tactile signal.

FIG. 11 is a functional-block diagram of an embodiment of this invention that functions by providing an electrical signal from one or more oscillators 60*a, b* through contacts 110 to paths of the secret pattern. The signals are sensed by probe tip 8, transmitted by means of cable 6 to amplifier 111 and one or more detectors 112*a, b.* One oscillator frequency may be used for pattern paths and a different frequency used for the end point; frequency-selective circuits in detectors 112*a, b* activate separate sensory signals for each frequency. Also depicted in this embodiment is a tactile signal functioning as the indicator; the tactile signals are provided by electrically-activated mechanical vibrators 113*a, b.*

Figure 4D:
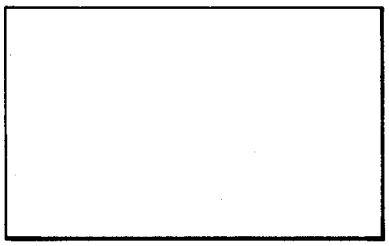
Figure 12:
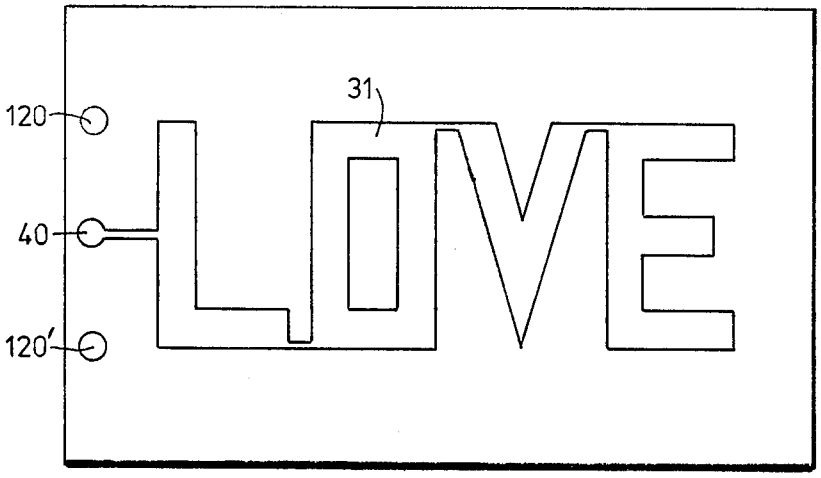
FIG. 12 is an example of a secret pattern that is not a maze.

It is also contemplated that non-maze puzzles also may be employed within the principles of this invention. An example of such a puzzle is shown laid out as a conductive pattern in FIG. 12, in which pattern paths 31 form the word "love". The pattern is concealed by the playing surface, which in this case is preferably gridless as depicted in FIG. 4D. The player probes the playing surface with the selector, receiving the indicator sensory signal when the selector is over one of the paths; spot sampling or full area scanning techniques may be used to discover the solution property of the secret pattern which is that the pattern spells the word "love". It may not be necessary for a skillful player to learn the complete pattern in order to discover the solution property. Since game cards containing such non-maze patterns would probably use the construction of FIG. 5B, connection to background layer 36 is made through apertures 120 formed through surface layer 33 and insulative layer 35.

A novel and interesting aspect of the present invention is the potential for meaningful scoring. In conventional printed mazes, the length of time required to reach the end is sometimes taken as the score; with the present invention, since the object is not only to find a continuous path but traverse is without error, a more appropriate scoring would be the number of attempts required to complete the game by achieving an errorless traverse of the true path. However, more complex scoring is made possible by the nature of the present invention, since the indicator signal permits counting of errors by an observer, or counters and timers may be easily added to the game apparatus, thus full account of the number of errors made and time taken can be automatically made.

The objective of the scoring method should be to emphasize skill and minimize chance as contributors to the score. Chance is inherent in the game only in the first attempt; a perfectly skillful player, once traversing the true path, would reproduce it without error on the next attempt. However, even the first attempt is not fully controlled by chance, and skillful players can minimize the time and number of errors on the first try. Knowledge of pattern rules (so as to avoid taking paths that can lead only into loops or dead-ends) and awareness of the paths already traversed can help a player avoid time consuming and error producing mistakes. Skill in manipulation of the probe also should improve the score, so that quick reaction time when an off-path indication is received is important.

Ideally, scoring should incorporate the effect of four factors:

(1) the time required to perform each attempt;
(2) the number of attempts;
(3) the number of off-path errors made in each attempt;
(4) the complexity of the secret pattern.

Incorporation of pattern complexity into the scoring is desirable so that the score will represent the player's skill independent of pattern difficulty.

An example of a scoring method that could provide a standard for player skill is:

$$S = \frac{1}{C} \sum_{i=1}^{n} iT_i + (i-1)E_i$$

where $S$ is the player's normalized score,
$C$ is the pattern complexity factor,
$n$ is the number of attempts,
$T_i$ is the time taken on the $i$'th attempt, and
$E_i$ is the number of errors made on the $i$'th attempt.

As the above formula indicates, the objective is to achieve as low a value of S as possible; and the penalty is large for high values of $n$, the total number of attempts. Note that the error count for each attempt is multiplied by $(i-1)$ so that the number of errors made on the first attempt do not enter into the score.

An example of a possible pattern complexity factor derivation is given in the following formula:

$$C = \hat{T}_1 (N_3 + N_j)$$

where $\hat{T}_1$ is the expected value of time required for the first attempt;
$N_s$ is the number of segments on the true path, and
$N_j$ is the number of junctions on the true path.

The quantity $\hat{T}_1$ is composed of three components:

$$\hat{T}_1 = N_s t_s + 2\hat{S}_{de} t_s + \hat{E}_1 t_e$$

where $\hat{S}_{de}$ is the expected number of segments traversed due to selection of dead-ends in the first attempt,
$\hat{E}_1$ is the expected number of errors in the first attempt,
$t_s$ is the time required to traverse one segment, and
$t_e$ is the time taken in discovering an error.

The factor $\hat{T}_1$ in the formula for C incorporates the characteristic of overall complexity in the pattern, including the number of choices that are available and the number of dead-ends in the pattern. The multiplying factor 2 in the $\hat{S}_{de}$ term is to account for the fact that when a dead-end path is traversed it must be retraced in returning to the true path thereby traversing such a path twice. Values for $t_s$ and $t_e$ may be determined experimentally, and techniques for computation of $\hat{S}_{de}$ and $\hat{E}_1$ are well known in the field of probability and statistics.

The factor $(N_s + N_j)$ is included in the formula for C in order to introduce a factor that represents the difficulty involved in remembering a secret pattern. A short pattern with few junctions is easily remembered, therefore the complexity factor C is made to increase with path length and number of junctions. The numerical value of factor C is preferably clearly marked on the game cards, so that players may select the degree of difficulty of the game as well as compute their normalized scores.

For games that do not involve seeking and learning a path, such as message detection, diagram detection, or picture detection, straightforward timing of the solution time is most appropriate.

Various combinations and modifications of the apparatus herein disclosed may be made following the principles of the invention. For example, multiple playing surfaces may be provided for competitive playing, or automatic scoring techniques may be employed. Substitutions of materials, circuit techniques, and variations of the physical shapes of the various components may be made within the principles of the invention and may readily occur to those skilled in the art; it is therefore intended that the invention be limited only by the appended claims.

What is claimed is:

1. A game or test of skill comprising:

a playing surface concealing a pattern of paths;

a means for selecting areas or points on said playing surface;

electronic circuit means connected to said selecting means and said pattern of paths, wherein said selecting means and said pattern of paths, during said selection of areas or points, comprise electronic circuit coupling for said electronic circuit means, and said circuit coupling is effected by electromagnetic fields between said selecting means and said pattern of paths; and an indicator means, activated by said electronic circuit means in response to said electronic circuit coupling, for revealing whether the selected point on said surface corresponds to a point on said pattern of paths; in which the object of the game is to discover properties of the concealed pattern.

2. The game of claim 1 wherein said pattern of paths includes a start point, an end-point, and at least one continuous path connecting said start point with said end-point.

3. The game of claim 1 wherein said selector means is a pencil-shaped device the point of which is placed upon said playing surface to perform selection of areas or points.

4. The game of claim 1 wherein said indicator means is a sensory signal.

5. The game of claim 2, wherein said indicator means provides a first signal when a path portion other than the end-point is selected by said sensing means and provides a second signal, distinct from said first signal, when said endpoint is selected.

6. The game of claim 1 wherein said playing surface is provided with a visible grid indicating the possible points on which components of said concealed pattern may exist.

7. The game of claim 1 wherein said playing surface is provided with a tactile grid indicating the possible points on which components of said concealed pattern may exist.

8. An electronic game apparatus comprising:

a card in which is concealed a pattern of electrically conductive areas;

a means, into which said card may be inserted, for making contact between said conductive areas and an electronic circuit; and a probe which can be placed in contact with the surface of said card but not in contact with said conductive areas; and connected to said electronic circuit such that said electronic circuit detects the proximity of said probe to said electrically conductive areas and generates a sensory signal when said probe is in proximity to selected areas of said concealed pattern.

9. The apparatus of claim 8 wherein said proximity detection means comprises an electrical signal generated by said electronic circuit sent to said probe and said electronic signal is sensed by said conductive areas in association with said electronic circuits connected to said conductive areas in said card.

10. The apparatus of claim 8 wherein said proximity detection means comprises an electrical signal generated by said electronic circuit sent to selected conductive areas in said card and said electrical signal is sensed by said probe in association with said electronic circuits connected to said probe.

11. A secret pattern device for a concealed pattern detection game comprising:

an insulating layer providing a playing surface for the game, and a conductive pattern on the opposed side of said insulating layer from said playing surface wherein a visible pattern is formed on the playing surface of said insulating layer, with said conductive pattern aligned with selected portions only of said visible pattern.

12. A secret pattern device for a concealed pattern detection game comprising:

an insulating layer providing a playing surface for the game, and a conductive pattern on the opposed side of said insulating layer from said playing surface wherein a tactile pattern is formed on the playing surface of said insulating layer, with said conductive pattern aligned with selected portions only of said tactile pattern.

13. A game or test of skill comprising:

a cathode-ray tube the surface of which comprises a playing surface on which is displayed a grid or pattern implying a secret pattern of paths, wherein said secret pattern includes a start point, an end point, and at least one continuous path connecting said start point with said end point;

a means for selecting areas or points on said playing surface; and an indicator means, in association with said selecting means, for impermanently revealing whether the selected point on said playing surface corresponds to a point on said secret pattern of paths; in which the object of the game is to discover properties of the secret pattern.

* * * * *